US011346162B2

(12) United States Patent
Sui et al.

(10) Patent No.: US 11,346,162 B2
(45) Date of Patent: May 31, 2022

(54) FORMATION TESTER TOOL

(71) Applicant: Halliburton Energy Services, Inc., Houston, TX (US)

(72) Inventors: Ping Sui, The Woodlands, TX (US); Nanjun Liu, Ann Arbor, MI (US); Varun Gupta, Richland, WA (US); Yu-Hsing Charles Kuo, Sugar Land, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 376 days.

(21) Appl. No.: 16/075,453

(22) PCT Filed: Jun. 7, 2016

(86) PCT No.: PCT/US2016/036192
§ 371 (c)(1),
(2) Date: Aug. 3, 2018

(87) PCT Pub. No.: WO2017/214177
PCT Pub. Date: Dec. 14, 2017

(65) Prior Publication Data
US 2019/0055792 A1 Feb. 21, 2019

(51) Int. Cl.
*E21B 17/10* (2006.01)
*E21B 49/10* (2006.01)

(52) U.S. Cl.
CPC ..... *E21B 17/1014* (2013.01); *E21B 49/10* (2013.01)

(58) Field of Classification Search
CPC ..... E21B 49/10; E21B 47/01
See application file for complete search history.

(56) References Cited

U.S. PATENT DOCUMENTS 6,658,930 B2 * 12/2003 Abbas ..... E21B 49/10 166/264
7,260,985 B2 8/2007 Gilbert et al.
7,584,655 B2 * 9/2009 van Zuilekom ..... E21B 49/088 166/100

(Continued)

FOREIGN PATENT DOCUMENTS

WO 2005072430 A2 8/2005

OTHER PUBLICATIONS

PCT Application Serial No. PCT/US2016/063192, International Search Report, dated Feb. 24, 2017, 3 pages.

(Continued)

*Primary Examiner* — Nicole Coy
(74) *Attorney, Agent, or Firm* — Delizio, Peacock, Lewin & Guerra

(57) ABSTRACT

A formation tester tool assembly includes a seal member mounted on rigid stabilizer that contacts a borehole wall separately from the seal member, so that seal exposure to a stabilization load that presses the tool against the borehole wall is limited or reduced by contact engagement of the stabilizer with the borehole wall. The stabilizer is provided by a hydraulically actuated probe piston reciprocally movable relative to a tool body on which it is mounted. The seal member is in some embodiments movable relative to the probe piston, for example being configured for hydraulic actuation to sealingly engage the borehole wall while the tool body is stabilized by action of the probe piston.

23 Claims, 10 Drawing Sheets

(56) References Cited

U.S. PATENT DOCUMENTS

| | | | | |
|---|---|---|---|---|
| 7,584,786 | B2 * | 9/2009 | Nold, III | E21B 49/10 166/100 |
| 7,793,713 | B2 * | 9/2010 | Nold, III | E21B 49/10 166/100 |
| 8,806,932 | B2 * | 8/2014 | Roessler | E21B 49/10 73/152.26 |
| 9,163,500 | B2 * | 10/2015 | Tao | E21B 17/1014 |
| 10,260,339 | B2 * | 4/2019 | Corre | E21B 49/10 |
| 2006/0075813 | A1 | 4/2006 | Fisseler et al. | |
| 2008/0295588 | A1 | 12/2008 | Van Zuilekom et al. | |
| 2010/0155053 | A1 | 6/2010 | Tao et al. | |
| 2011/0162836 | A1 | 7/2011 | Church | |
| 2014/0027112 | A1 | 1/2014 | Irani et al. | |

OTHER PUBLICATIONS

PCT Application Serial No. PCT/US2016/063192, International Written Opinion, dated Feb. 24, 2017, 13 pages.
European Application Serial No. 16904782.6; Extended European Search Report; dated Dec. 16, 2019, 9 pages.

* cited by examiner

FORMATION TESTER TOOL

BACKGROUND

During the drilling and completion of oil and gas wells, it is often necessary to test or measure some formation properties that can best be evaluated by exposure of a measuring tool to formation fluid and/or formation fluid pressure. Such formation properties include, but are not limited to, fluid type, fluid quality, bubble point, formation pressure, and formation pressure gradient.

Commonly used methods for performing these tests using wireline formation testers (WFT) or drill stem testers (DST) include the creation of an axially extending zone within the wellbore that is isolated from the drilling fluid column. Tool valves or ports are then opened to allow flow from the formation to the tool for testing while recorders chart static pressures. A sampling chamber in some cases traps clean formation fluids at the end of the test. Some formation testing methods, however, comprise bringing a probe mechanism forming part of the tester tool physically into contact with the formation, without creating zonal isolation by the use of separate packers or the like. Tester tools using such probe mechanisms can be deployed a number of different modes, for example as part of a wireline tool string, on a pipe string, or integrated in a drill string for use in measuring while drilling (MWD) and/or logging while drilling (LWD).

The probe mechanism typically includes an isolation pad mounted on a radially outer end of a piston assembly that serves to extend the isolation pad into engagement with the borehole wall. The isolation pad seals against the formation and around a hollow probe that is in fluid connection with measurement instrumentation housed by the tool. This creates a fluid pathway that allows formation fluid to flow between the formation and the measurement instrumentation in the formation tester while being isolated from the borehole fluid. In order to acquire a useful sample and/or to achieve accurate pressure measurement, the probe must stay isolated from the relatively high pressure of the borehole fluid. For this reason, the integrity of the seal formed by the isolation pad is critical to performance of the tester tool. If the borehole fluid is allowed to leak past the sealing interface between the isolation pad and the borehole wall, pressure measurements of the probe mechanism are compromised, and any samples obtained might be nonrepresentative.

BRIEF DESCRIPTION OF THE DRAWINGS

Some embodiments of the disclosure are illustrated by way of example and not limitation in the figures of the accompanying drawings, in which.

DETAILED DESCRIPTION

Figure 1:
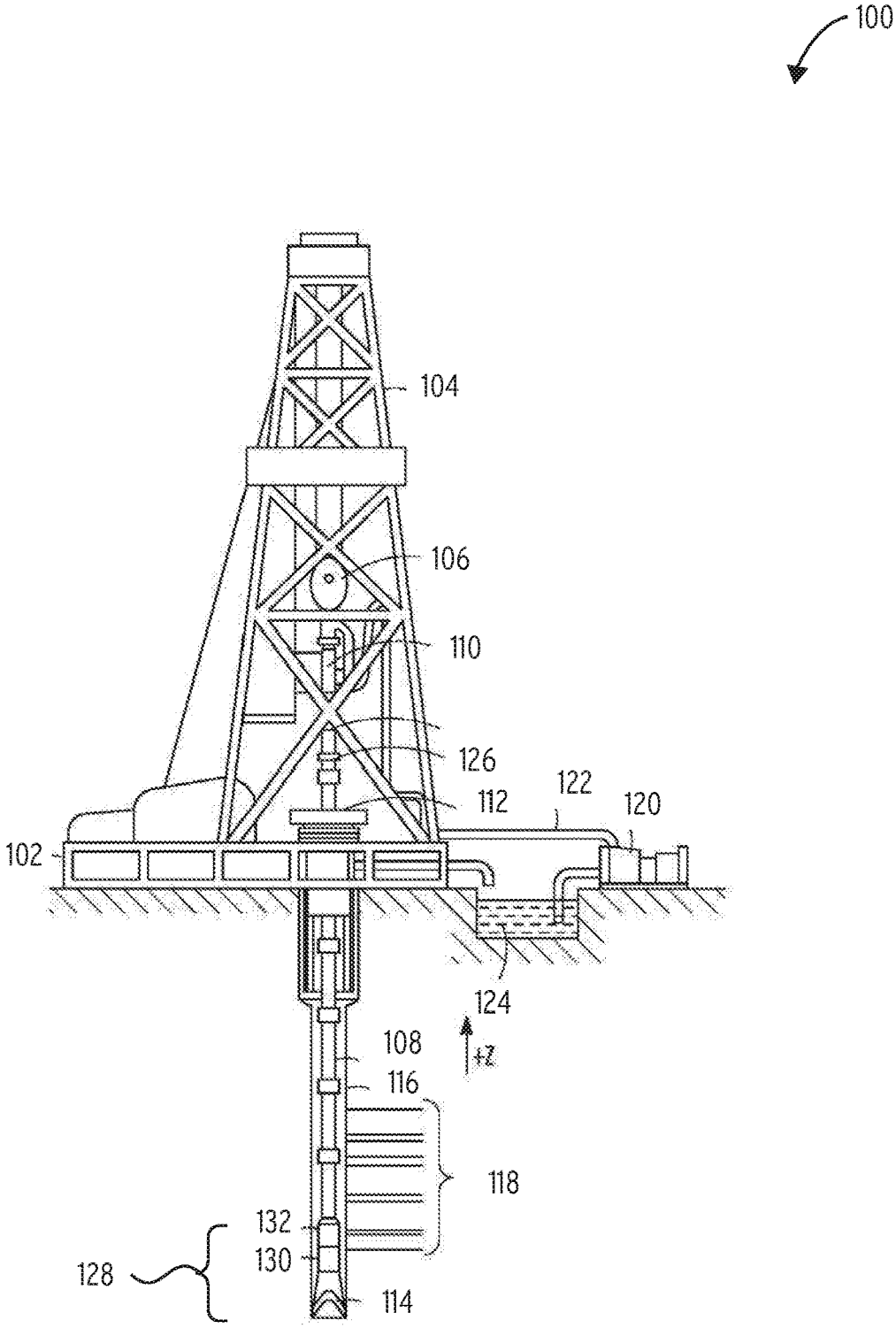
FIG. 1 depicts a schematic view of a drilling installation that includes a drill string having incorporated therein a formation tester tool according to one example embodiment.

One aspect of the disclosure provides for a formation tester tool in which seal exposure to a stabilization load that presses the tool against the borehole wall is limited or reduced by mounting a seal member on a rigid stabilizer that directly contacts the borehole wall separately from the seal pad. The tool is thus configured such that radially directed forces exerted by the tool on the borehole wall (which are cumulatively referred to herein as the stabilizing load) are shared by the seal member and a contact formation forming part of the stabilizer.

In some embodiments, the stabilizer is a hydraulically actuated probe piston that is mounted on a tool body for reciprocal actuated movement in a direction substantially radial relative to a lengthwise direction of the borehole between a retracted condition and a deployed condition in which it is in contact engagement with the borehole wall and is urged radially outwardly to stabilize the tool body within the borehole. In some embodiments, the seal member comprises a seal pad mounted on the probe piston to be radially displaceable (relative to the lengthwise direction of the borehole), while the probe piston is in the deployed condition, between a disengaged position and an engaged position in which the seal pad bears sealingly against the borehole wall.

In some embodiments, a seal actuating arrangement forming part of the tool is configured for causing hydraulically actuated displacement of the seal on the probe piston, and is further configured for continuously urging the seal pad into sealing contact with the borehole wall. The seal actuating arrangement (also referred to as a seal displacement mechanism in this description) in some embodiments includes a hydraulic seal displacement chamber defined by a substantially annular recess in a radially outer end of the probe piston.

Benefits of the disclosed tool include that it provides for prolonged seal life owing to subjection to reduced compressive loads when compared to existing tools in which the stabilization load is transferred to the borehole wall entirely via the seal pad. Additionally, mobility of the seal pad relative to the probe piston (which serves as a rigid stabilizer in some embodiments) reduces sensitivity of the tool to misalignment with the borehole wall. A seal can thus in some embodiments be made even when a shaped curvature of the radially outer end of the probe piston is not aligned well with the corresponding cylindrical curvature of the borehole wall.

These and further aspects of the disclosure will be described in further detail below with reference to specific example embodiments.

The following detailed description describes example embodiments of the disclosure with reference to the accompanying drawings, which depict various details of examples that show how various aspects of the disclosure may be practiced. The discussion addresses various examples of novel methods, systems, devices and apparatuses in reference to these drawings, and describes the depicted embodiments in sufficient detail to enable those skilled in the art to practice the disclosed subject matter. Many embodiments other than the illustrative examples discussed herein may be used to practice these techniques. Structural and operational changes in addition to the alternatives specifically discussed herein may be made without departing from the scope of this disclosure.

In this description, references to "one embodiment" or "an embodiment," or to "one example" or "an example" in this description are not intended necessarily to refer to the same embodiment or example; however, neither are such embodiments mutually exclusive, unless so stated or as will be readily apparent to those of ordinary skill in the art having the benefit of this disclosure. Thus, a variety of combinations and/or integrations of the embodiments and examples described herein may be included, as well as further embodiments and examples as defined within the scope of all claims based on this disclosure, as well as all legal equivalents of such claims.

FIG. 1 is a schematic illustration of an example drilling system 100 that embodies techniques consistent with this disclosure in a logging while drilling (LWD) and/or a measuring while drilling (MWD) environment. As will be described in further detail below, a MWD formation tester tool 130 is illustrated as forming part of a bottomhole assembly (BHA 128) that is integrated in a drill string 108 and that comprises a drill bit 114 at its lowermost end.

A drilling platform 102 is equipped with a derrick 104 that supports a hoist 106 for raising and lowering a drill string 108. The hoist 106 suspends a top drive 110 suitable for rotating the drill string 108 and lowering the drill string 108 through the wellhead 112. Connected to the downhole end of the drill string 108 is the bottomhole assembly (BHA 128) that includes the drill bit 114 and the tester tool 130. As the bit 114 rotates, it creates a borehole 116 that passes through a formation 118 containing hydrocarbons that are to be extracted via the borehole 116. The borehole 116 has a circular outline in cross-section, and is therefore defined by a circular cylindrical borehole wall extending circumferentially around a central longitudinally extending tool axis.

A pump 120 circulates drilling fluid through a supply pipe 122 to top drive 110, down through the interior of the drill string 108, through orifices in bit 114, back to the surface via an annulus around drill string 108, and into a retention pit 124. The drilling fluid transports cuttings from the borehole 116 into the pit 124 and aids in maintaining the integrity of the borehole 116. Various materials can be used for drilling fluid, including a salt-water based conductive mud.

In addition to the drill bit 114 and the tester tool 130, the BHA 128 includes a steering assembly, one or more additional measuring tools, a drill collar, and a controller module 132.

Measuring tools forming part of the BHA 128 in this example embodiment includes a measuring while drilling (MWD) sensor package that may include one or more survey mechanisms configured to collect and transmit directional information, mechanical information, and the like. In particular, the survey mechanisms may include one or more internal or external sensors such as, but not limited to, an inclinometer, one or more magnetometers, (i.e., compass units), one or more accelerometers, a shaft position sensor, combinations thereof, and the like. Directional information (i.e., wellbore trajectory in three-dimensional space) of the BHA 128 within the earth (FIG. 1), such as inclination and azimuth, may be obtained in real-time using the survey mechanisms.

The BHA 128 in this example embodiment further includes a logging while drilling (LWD) sensor package that may include one or more sensors configured to measure formation parameters such as resistivity, porosity, sonic propagation velocity, neutron density, or gamma ray transmissibility. In this example embodiment, the formation tester tool 130 is provided as part of a separate sub, but in other embodiments the tester tool 130 may be incorporated as part of the LWD sensor package.

In some embodiments, the MWD and LWD tools, and their related sensor packages, may be in communication with one another to share collected data therebetween. Any measurements obtained from measuring tools forming part of the BHA 128 can be processed either at the surface or at a downhole location. The controller module 132 may be a downhole computer system communicably coupled to each their respective sensoring, measuring, and steering tools forming part of the BHA 128. In some embodiments, the controller module 132 may further be communicably coupled to the surface via one or more communication lines such that it is able to send and receive data in real time to/from the surface during operation. The communication lines between components of the BHA 128 and/or between the BHA 128 and surface control systems may be any type of wired telecommunications devices or means known to those skilled in the art such as, but not limited to, electric wires or lines, fiber optic lines, etc. Alternatively or additionally, the controller module 132 may include or otherwise be a telemetry module used to transmit measurements to the surface wirelessly, if desired, using one or more downhole telemetry techniques including, but not limited to, mud pulse, acoustic, electromagnetic frequency, combinations thereof, and the like.

Although the drilling system 100 is shown and described in FIG. 1 with respect to a rotary drill system, it will be appreciated that many types of drilling systems can be employed in carrying out embodiments consistent with the disclosure. For instance, drills and drill rigs may in some embodiments be used onshore (as depicted in FIG. 1) or offshore (not shown). Offshore oil rigs that may be used in accordance with embodiments of the disclosure include, for example, floaters, fixed platforms, gravity-based structures, drill ships, semisubmersible platforms, jack-up drilling rigs, tension-leg platforms, and the like. Further, although described herein with respect to oil drilling, various embodiments of the disclosure may be used in many other applications. For example, disclosed techniques can be used in drilling for mineral exploration, environmental investigation, natural gas extraction, underground installation, mining operations, water wells, geothermal wells, and the like.

It is again emphasized that, even though the formation tester tool 130 is described in this example embodiment as forming part of a drill string 108, the tool 130 may in other embodiments be conveyed downhole using a drill string, wireline, or analogous technology, as is partially described above and as is well known to persons skilled in the art.

Figure 2:
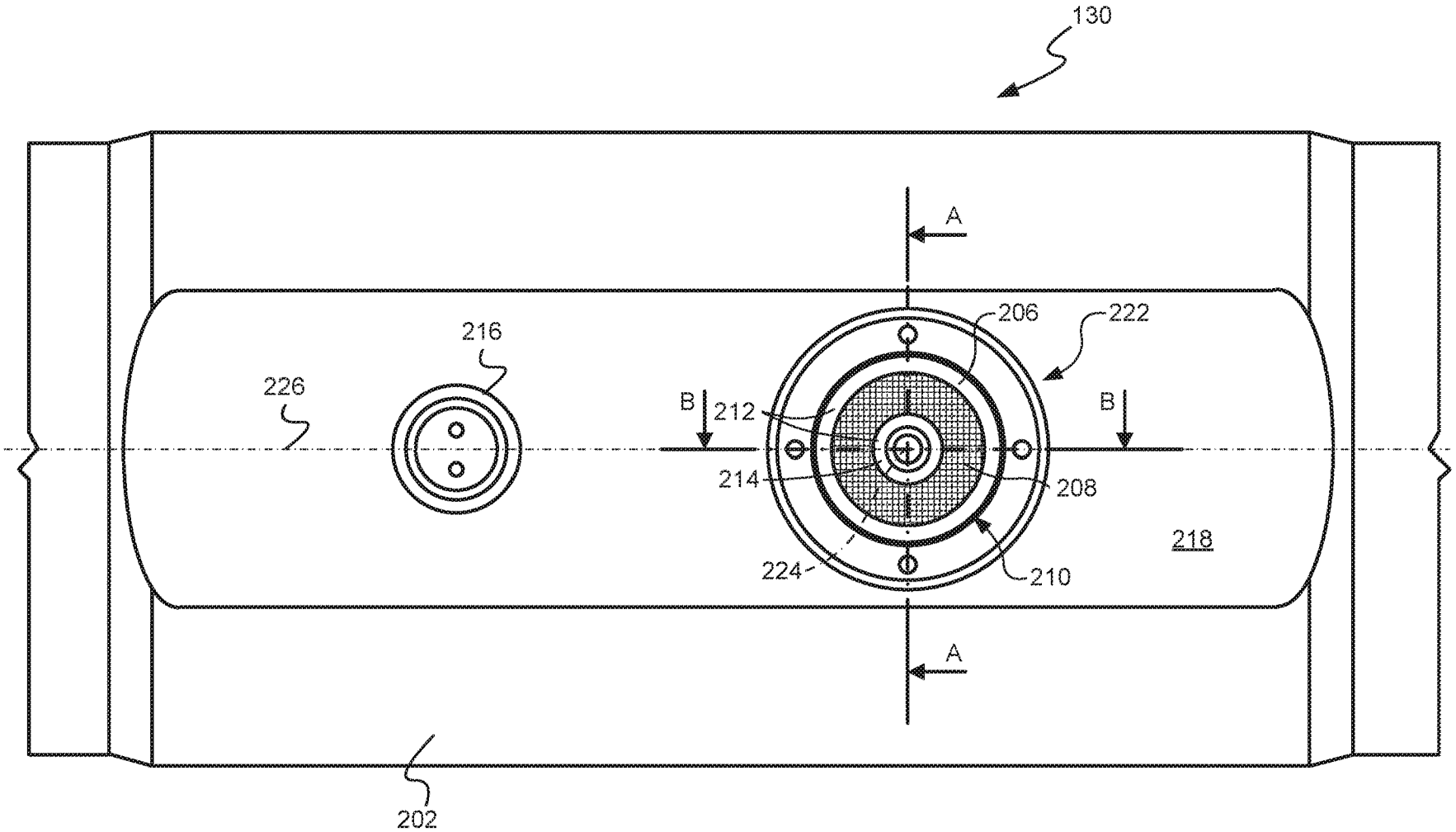
FIG. 2 depicts a schematic side view of a formation tester tool according to one example embodiment, a probe assembly forming part of the tester tool being viewed in end view.

FIG. 2 shows, on an enlarged view, a side view of the exterior of the tester tool 130 forming part of the BHA 128 of FIG. 1. The tool 130 has a tool body provided by a housing 202 comprising one or more sections of heavy-walled drill pipe connected together end-to-end and being incorporated in line in the drill string 108. The tubular wall of the housing 202 thus, during drilling, transfers torque and rotation between drill pipe sections connected at opposite ends thereof. A fluid conveyance passage extends lengthwise through the housing 202, in use being in fluid flow communication with neighboring drill pipe sections and thus forming part of a drill string bore 220 (see FIG. 7) along which drilling fluid is in use conveyed along the drill string 108.

The housing 202 houses a probe assembly 222 configured for lateral expansion and engagement with the formation to test one or more fluid properties of the formation 118. The construction and working of the probe assembly 222 will be described with reference to FIGS. 3-9, which also illustrate various internal components of the probe assembly 222. Components of the probe assembly 222 which are at least partially visible in the exterior view of FIG. 2 include a probe piston 206, a seal pad 208, and a snorkel 214. The functions of these components will become clear from what follows.

Note that the view of FIG. 2 is taken in a direction parallel to a probe axis 224 along which the probe piston 206 is movable during lateral expansion of the probe assembly 222. The probe axis 224 is disposed transversely to the borehole axis 226, generally extending substantially radially relative to the borehole axis 226. The probe piston 206 has a generally annular radially outer end portion (i.e., radially outer relative to the borehole axis 226) that has a substantially circular outer diameter (relative to the probe axis 224), and a substantially circular concentric inner diameter, as can be seen in the view of FIG. 2.

The seal pad 208 is likewise generally annular in shape, having an inner diameter larger than the inner diameter of the probe piston 206, and having an outer diameter smaller than the diameter of the probe piston 206. The seal pad 208 is mounted on the probe piston 206, in this example embodiment being located in a complementary annular recess 210 defined in the outer end face of the probe piston 206. The remainder of the radially outer end face of the probe piston 206 (that is, the end face of the probe piston 206 that faces radially outwards relative to the borehole axis 226 and that is viewed substantially face-on in FIG. 2) therefore consists of two annular surfaces (e.g., circular strips) extending circumferentially about the inner diameter of the seal pad 208 and the outer diameter of the seal pad 208, respectively. This pair of annular surfaces of the probe piston 206 together provide a wall contacting structure or contact surface 212 shaped and configured for rigid contact engagement with the borehole wall 228 during formation testing.

Figure 4:
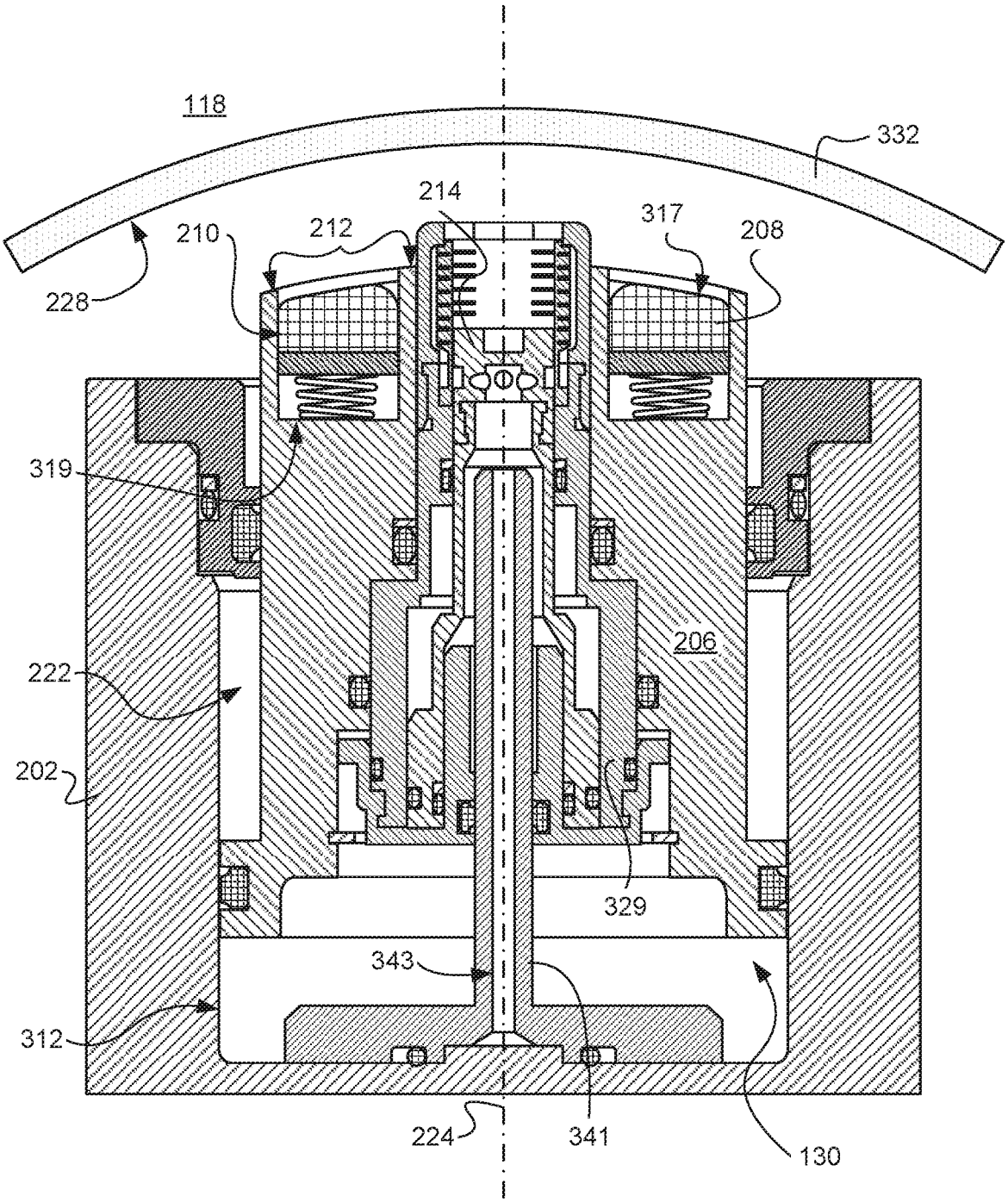
FIG. 4 depicts part of a formation tester tool in schematic cross-section corresponding to that of FIG. 4, the probe assembly being in a partially deployed condition.
Figure 5:
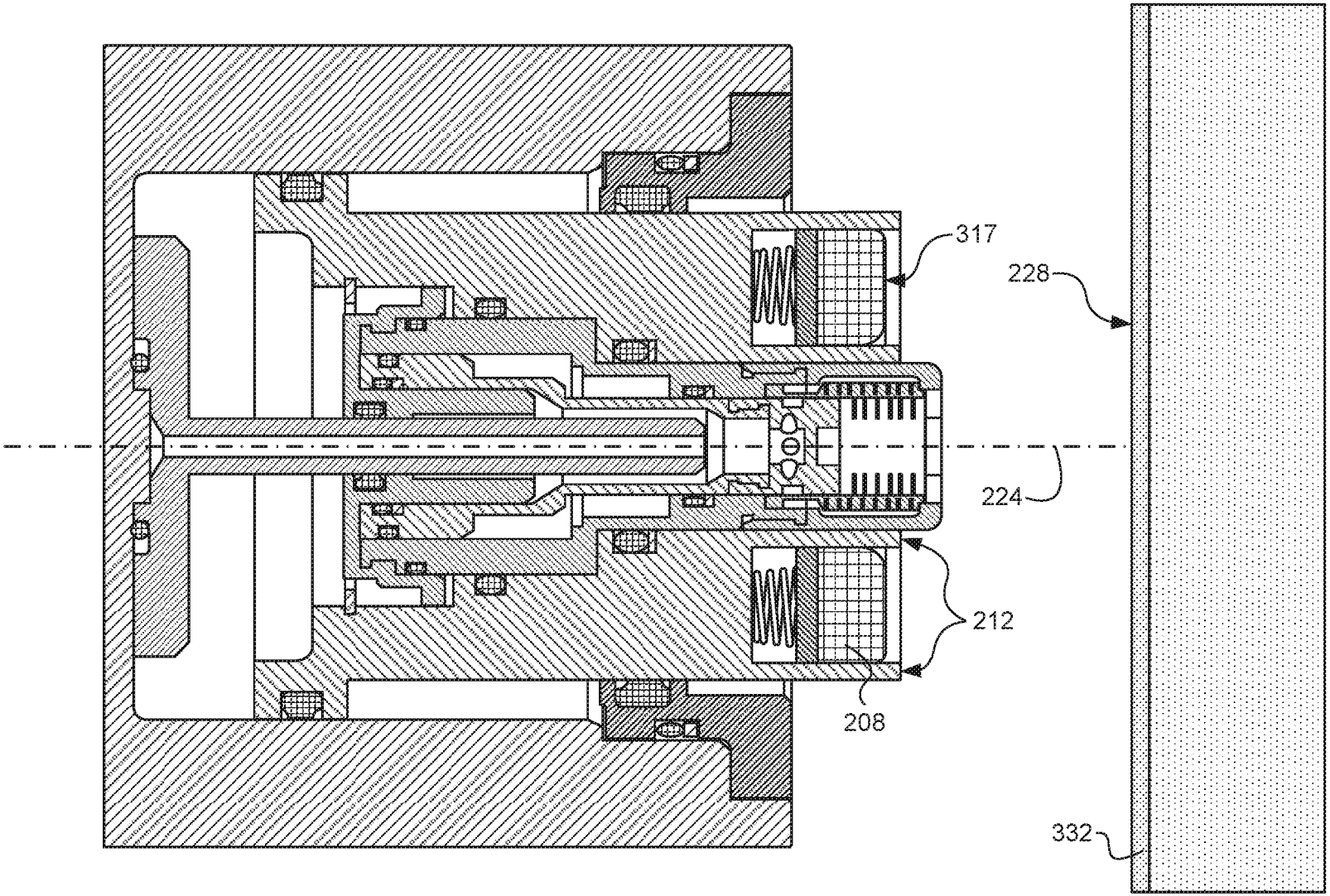
FIG. 5 depicts a schematic longitudinal section of an example formation tester tool in a partially deployed condition corresponding to that of FIG. 4, the longitudinal section being taken along lines B-B in FIG. 1.

As will be understood from the description that follows and from viewing FIG. 2, FIG. 4, and FIG. 5 in combination, the contact surface 212 and the outer surface of the seal pad 208 is contoured to conform to the right circular cylindrical surface of the borehole wall 228, thus having a simple cylindrical curvature substantially identical to that of the borehole wall 228. The contact surface 212 and the outer surface of the seal pad 208 are thus both shaped to allow them to be pressed flush against the borehole wall 228.

FIG. 2 also shows an equalizer valve 216 that forms part of the formation tester tool 130 and that it opens out of the radially outer surface of the housing 202. Both the probe assembly 222 and the equalizer valve 216 are set in a recessed portion of the radially outer surface of the housing 202, which defines a planar flat 218.

The equalizer valve 216 and various hydraulic actuation, control, and measurement components whose working is not described explicitly in this disclosure may function substantially similar to the corresponding components of analogous existing formation testing tools, such as, for example, that described in U.S. Pat. No. 7,216,533 to McGregor, et al. (filed May 19, 2005 and titled Methods for Using a Formation Tester), which is by this reference incorporated herein in its entirety.

Figure 3:
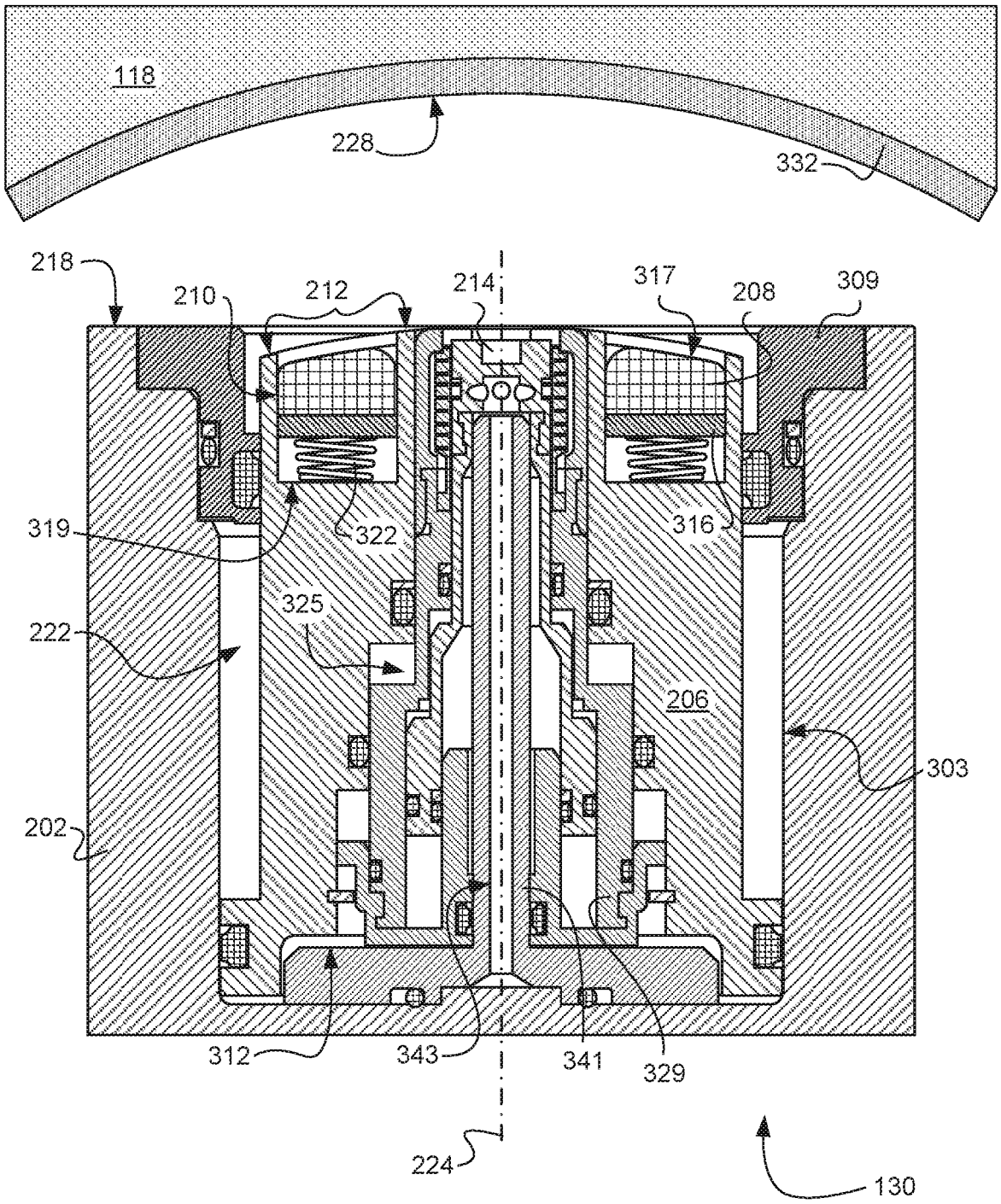
FIG. 3 depicts a schematic cross-section of a part of a formation tester tool according to an example embodiment, taken along line A-A in FIG. 1, a probe assembly forming part of the tool being shown in an interactive mode.

FIG. 3 shows, on an enlarged scale, a cross-section of a part of the formation tester tool 130, including the probe assembly 222. The probe assembly 222 is shown in FIG. 3 in a retracted condition in which the probe piston 206 is located wholly within the housing 202. Note that the view of FIG. 3 is taken along line A-A in FIG. 2, thus being cross-sectional relative to the borehole axis 226, as can be seen from the circular curvature of the borehole wall 228 in FIG. 3. The probe piston 206, however, is shown in longitudinal section in FIG. 3, as the probe axis 224 lies within the plane of section. With this orientation in mind, note that the contact surface layer 304 212 of the probe piston 206 can be seen in FIG. 3 to have a part circular sectional outline similar to that of the borehole wall 228. As will be seen with reference to later figures, the borehole wall 228 and the contact surface 212 of the probe piston 206 have substantially identical radii of curvature in the cross-sectional plane of FIG. 3.

The housing 202 defines a generally cylindrical cavity 303 within which the probe piston 206 is slidingly received for reciprocal linear displacement within the housing 202 in the direction of probe axis 224 (i.e., radially relative to the borehole axis 226). The outer diameter of the probe piston 206 seals slidingly not only against the cavity wall and its innermost end, but also seals adjacent a mouth of the housing cavity 303 circumferentially against a generally cylindrical adapter sleeve 309 fastened to the housing 202 to sealingly close off the mouth of the housing cavity 303. A hydraulic actuation chamber 312 is defined between the innermost end of the probe piston 206 and the housing 202 so that hydraulic expansion or contraction of the actuation chamber 312 responsive to controlled variations in fluid pressure of a hydraulic medium (e.g., hydraulic oil) within the actuation chamber 312 causes hydraulic actuated linear movement of the probe piston 206 fantasy the housing 202. As mentioned, the probe piston 206 is shown in its retracted condition in FIG. 3, so that the actuation chamber 312 is at a minimum size. The stroke length of the probe piston 206 is designed such that full extension of the probe piston 206 by operation of the hydraulic actuating mechanism of which the actuation chamber 312 forms part will result in a spacing along the probe axis 224 between the outermost end of the probe piston 206 and a diametrically opposite point on the exterior of the housing 202 being at least as large as the diameter of the borehole wall 228. This permits extension of the probe piston 206 into a deployed condition in which the contact surface 212 at the outer end of the probe piston 206 is pressed-forcefully against the borehole wall 228, and causing the housing 202 to be pressed against a diametrically opposite portion of the borehole wall 228, thereby to secure or stabilize the tester tool 130 in the borehole 116. More on this later.

The annular recess 210 and the seal pad 208 (which, as discussed, are visible in exterior end view in FIG. 2) can also be seen in cross-section in FIG. 3. The annular recess extends continuously about the probe axis 224 and has an axial depth (in the direction of the probe axis 224) to allow reception of the seal pad 208 wholly within the annular recess 210. The seal pad 208 is in this example embodiment mounted on a seal piston 316 provided by an annular or ring-shaped baseplate received in the annular recess 210 for reciprocal axial movement (in the direction of probe axis 224) relative to the probe piston 206 on which it is mounted.

In contrast to the probe piston 206, which is rigid and substantially non-deformable under the typically applicable loads, the seal pad 208 is nonrigid, being of an elastically deformable material selected for creating a fluid-tight seal against the borehole wall 228 when forced against it. In this example embodiment, the seal pad 208 is of an elastomeric material having a high elongation characteristic, in particular being hydrogenated Nitrile Butadiene Rubber (HNBR). In other embodiments, the seal pad 208 may be of any suitable elastically deformable sealing material.

The seal pad 208 is mounted on the radially outer annular face of the seal piston 316 (relative to the borehole axis 226), so that a substantially annular end face of the seal piston 316 provides a sealing surface 317 facing radially towards the borehole wall 228, relative to the borehole axis 226. In this example embodiment, the seal pad 208 is shaped such that the sealing surface 317 has a part-cylindrical curvature corresponding to that of the borehole wall 228 (and therefore also, in this example embodiment, corresponding to the curvature of the contact surface 212 of the probe piston 206). For this reason, the sealing surface 317 can be seen in FIG. 3 to have a part-circular outline in radial section, substantially corresponding in shape to both the borehole wall 228 and to the contact surface 212 of the probe piston 206.

In other embodiments, the seal pad 208 may have a differently shaped sealing surface 317. In one example embodiment, sealing surface may be generally part-toroidal or doughnut-shaped, so that the seal pad 208 has a substantially constant thickness throughout its circumference about the probe axis 224, being rotationally symmetrical about the probe axis 224. It will be appreciated that in embodiments such as that illustrated in FIG. 3 (where the radially outer surface of the seal piston 316 on which the seal pad 208 is mounted substantially flat while the sealing surface 317 of the seal pad 208 has a part-cylindrical curvature), the seal pad 208 has varying thicknesses at different circumferential positions about the probe axis 224. To achieve both a part cylindrical sealing surface 317 (for promoting effective sealing against the political borehole wall 228) and a circumferentially constant seal pad thickness reduce or avoid uneven deformation stresses and wear), the seal piston 316 may in some embodiments be shaped such that its outer surface on which the seal pad 208 is mounted has a part cylindrical curvature substantially similar to that of the sealing surface 317 of the seal pad 208.

The seal piston 316 is complementary to the annular recess 210 in its peripheral outline, so that the seal piston 316 is sealingly slidable in the annular recess 210. A sealed, generally annular seal piston chamber 319 is defined between an inner surface of the seal piston 316 and cavity walls of the annular recess 210 in the probe piston 206. The seal piston chamber 319 contains a hydraulic medium (in this example, hydraulic oil), and is in fluid communication via fluid flow lines defined by probe piston 206 with a hydraulic mechanism that allows for controlled pressurization and expansion of the seal piston chamber 319, thereby to cause actuated sliding movement of the seal piston 316 radially outwards in the direction of probe axis 224. In some embodiments, the seal displacement mechanism of which the seal piston chamber 319 forms part has a hydraulic circuit that is separate from a hydraulic circuit forming part of the hydraulic actuating mechanism for causing extension of the probe piston 206 by pressurized expansion of the actuation chamber 312. In other embodiments, the seal piston 316 and the probe piston 206 may be hydraulically actuated by a common hydraulic circuit, or by interconnected electronic circuits. In one example embodiment, the seal piston chamber 319 is isolated from the actuation chamber 312 by a pressure valve configured only to open above a specific threshold pressure. The threshold pressure is, for example, selected to be substantially equal or greater than the pressure at which the probe piston 206 has been moved to its deployed condition. Thus, ramping up hydraulic pressure in a single hydraulic mechanism causes hydraulically actuated displacement of the probe piston 206 into the deployed condition in which it bears against the borehole wall 228, after which the pressure valve automatically opens and causes hydraulically actuated displacement of the seal piston 316 radially outwards in the direction of the probe axis 224.

The sealing mechanism provided by the seal pad 208 and the dashpot-type seal displacement mechanism further includes a return mechanism that urges the seal pad 208 away from an engaged or extended position in which the outer surface of the seal pad 208 projects radially (relative to the borehole axis 226) beyond the contact surface 212 of the probe piston 206, and towards a disengaged or retracted position (as shown in FIG. 3) in which the contact surface 212 projects radially beyond outer sealing surface of the seal pad 208. In this example embodiment, the return mechanism is provided by a circumferentially spaced series of elastic tension springs 322 located in the seal piston chamber 319 and connected between the probe piston 206 and the seal piston 316 to act radially relative to the borehole axis 226 (thus acting in the direction of the probe axis 224). In unstressed position of the tension springs 322 corresponds to the retracted condition of the seal pad 208 (FIG. 3). Hydraulic extension of the seal pad 208 by the seal piston 316 is thus performed against the urging of the tension springs 322 resulting from their elastic deformation, while the absence of a sufficiently large hydraulic pressure in the seal piston chamber 319 results in automatic return of the seal pad 208 to the retracted position under the radially retracted the purging of the tension springs 322. It will be appreciated that a return mechanism such as that provided in this example embodiment by the arrangement of tension springs 322 can in other embodiments be provided by any one of a number of suitable alternative bias or actuating arrangements.

The probe assembly 222 further includes a snorkel assembly 325 mounted on the probe piston 206 for reciprocal telescopic movement to the probe piston 206 along the probe axis 224. The snorkel assembly 325 may be constructed and may function in a manner similar to analogous components of commonly available formation tester tools, such as the GeoTap™ LWD formation tester tool available from Sperry Drilling Services Inc.

The snorkel assembly 325 comprises a composite carrier piston 329 that is co-axially mounted on the probe piston 206 and is telescopically slidable within a central passage that extends through the probe piston 206. An innermost end of the carrier piston 329 borders the actuation chamber 312, so that the actuation chamber 312 is variable volume by relative displacement of the carrier piston 329 along the probe axis 224 (i.e., radially relative to the borehole axis 226). For clarity of illustration, the various components that together make up the composite carrier piston 329 are shown with identical hatching in FIG. 3. The same applies to the snorkel 214, which in this example embodiment is a composite structure mounted co-axially within the carrier piston 329 for reciprocal telescoping within the carrier piston 329.

An outer end of the snorkel 214 is shaped for penetrating a layer of mudcake 332 on the borehole wall 228. Mudcake buildup occurs when solid particles are plastered to the side of the wellbore by drilling mud that circulates during drilling through the annulus defined between the radially outer surface of the drill string 108 and the borehole wall 228. Presence of the mudcake 332 would adversely affect the accuracy of measurements taken by the tool 130. Penetration of the mudcake 332 by the snorkel 214, however, allows direct exposure of the interior of the probe assembly 222 to the formation, to provide for more accurate formation fluid property measurements.

The carrier piston 329 is co-axially received on a fixed tubular stem 341 that is co-axially aligned with the probe piston 206 and is fastened to the housing 202. The carrier piston 329 is sealingly engaged with the outer diameter of the tubular stem 341, so that a hollow interior of the tubular stem 341 defines a fluid measurement passageway 343 that is in fluid isolation from the actuation chamber 312 and is in fluid communication with the hollow interior of the snorkel 214. The passageway 343 is, in turn, in fluid communication with measurement and/or sampling instrumentation of the tool 130. The stem 341 and the snorkel 214 thus form part of a testing mechanism for testing one or more formation properties in the isolation zone.

Operation of the example tester tool 130 will now be described with reference to FIGS. 3-9, which together illustrated a sequence of stages of deployment and use of the tool 130. Initially, during downhole conveyance of the tool 130 as part of the drill string 108, and during active drilling by use of the drill string 108, the tool is disposed in an inactive mode, as illustrated and described with reference to FIG. 3. In the inactive mode, the probe piston 206 is in the retracted condition, being received in its entirety within the housing 202. The seal pad 208 is likewise in a disengaged position in which the entirety of the seal pad 208 is housed in the annular recess 210 of the probe piston 206. In this condition, the housing 202 is usually radially spaced from the borehole wall 228 for the entirety of its circumference, so that a substantially continuous borehole annulus is defined between the radially outer exterior of the drill string 108 and the borehole 116 (see, for example, FIG. 7A).

When formation testing is to be performed, rotation of the drill string 108 is ceased, and the probe assembly 222 is deployed by hydraulic actuation of the probe piston 206 via the actuation chamber 312. FIG. 4 shows the probe assembly 222 in an intermediate position during such actuated deployment. Note that the seal piston 316 and the seal pad 208 remain in their retracted, disengaged position in which the outer sealing surface 317 of the seal pad 208 is located radially inside of the contact surface 212 of the probe piston 206, relative to the borehole axis 226. Note also that the substantially similar cylindrical curvatures of the borehole wall 228, the sealing surface 317, and the contact surface 212 are similarly oriented, being more or less parallel to one another, to enable flush engagement between the respective surfaces.

FIG. 5 shows the probe assembly 222 in the same stage of deployment as in FIG. 4, but being viewed in longitudinal section taken along line B-B in FIG. 2, so that the borehole axis 226 lies in the plane of section. As can be seen, the borehole wall 228 in such longitudinal section has a rectilinear sectional outline. Note that both the contact surface 212 of the probe piston 206 and the sealing surface 317 of the seal pad 208 likewise have rectilinear sectional outlines in the plane of FIG. 5, and that the outlines of these surfaces are substantially parallel to one another.

Figure 6:
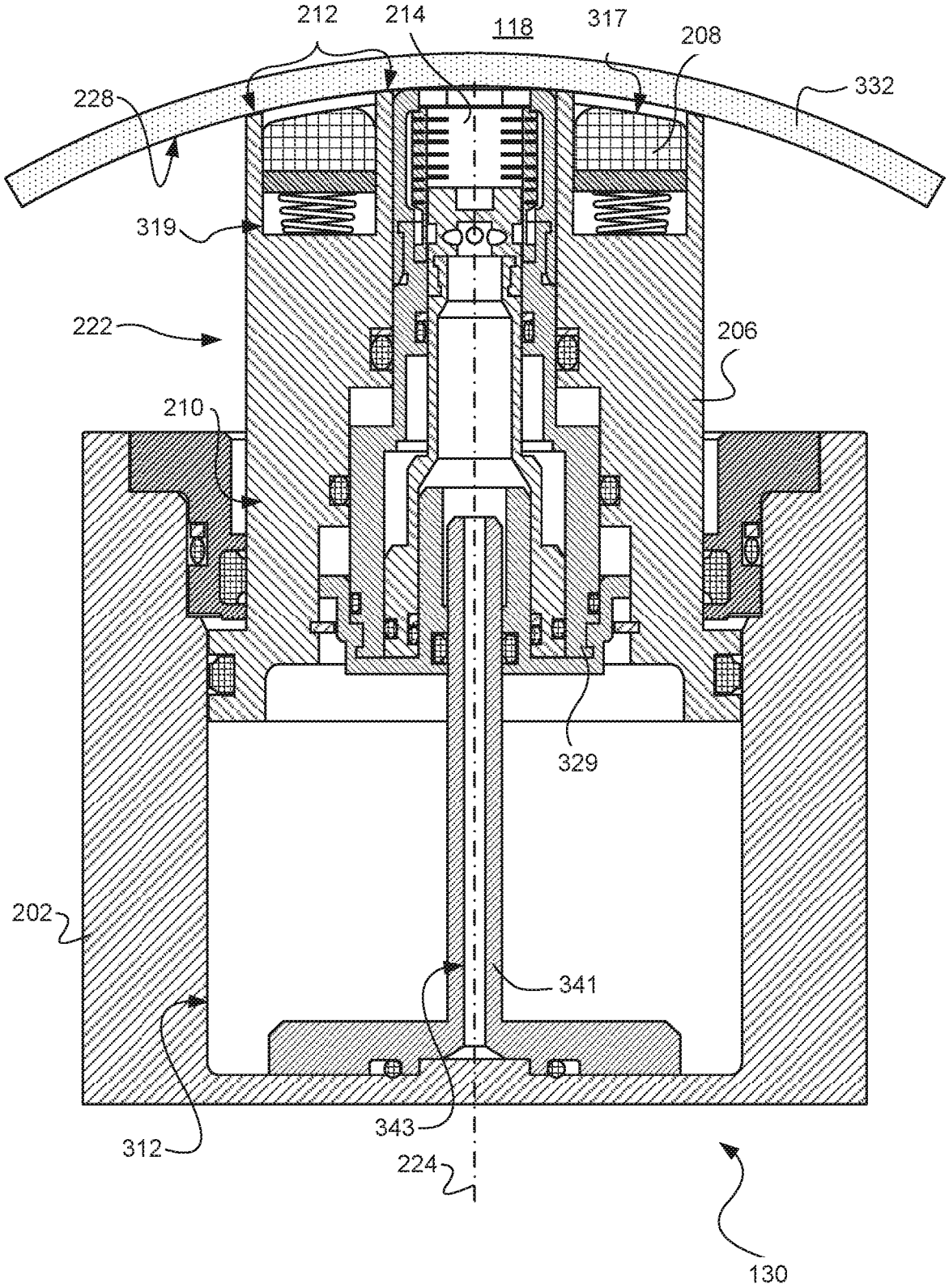
FIG. 6 depicts a schematic cross-section (taken along line A-A in FIG. 1) of an example formation tester tool that is disposed such that a probe piston is in a deployed condition in which it is in contact engagement with a borehole wall, a seal pad mounted on the probe piston being in a disengaged position.

Further radial extension of the probe piston 206 brings the contact surface 212 of the probe piston 206 into direct physical contact engagement with the borehole wall 228 provided by the radially inner surface of the mudcake 332, as shown in FIG. 6. Because the cylindrical contact surface 212 of the probe piston 206 initiate substantially to conform to the corresponding topology of the borehole wall 228, the contact surface 212 bears against the mudcake 332 with substantially even distribution of contact forces. Continued expansion of the probe piston 206 on hydraulic actuation causes the tool housing 202 to be pushed away from the contact engagement with the borehole wall 228, until lateral expansion of the probe assembly 222 is sufficient to secure or stabilize the tool 130 in the borehole 116.

Figure 7B:
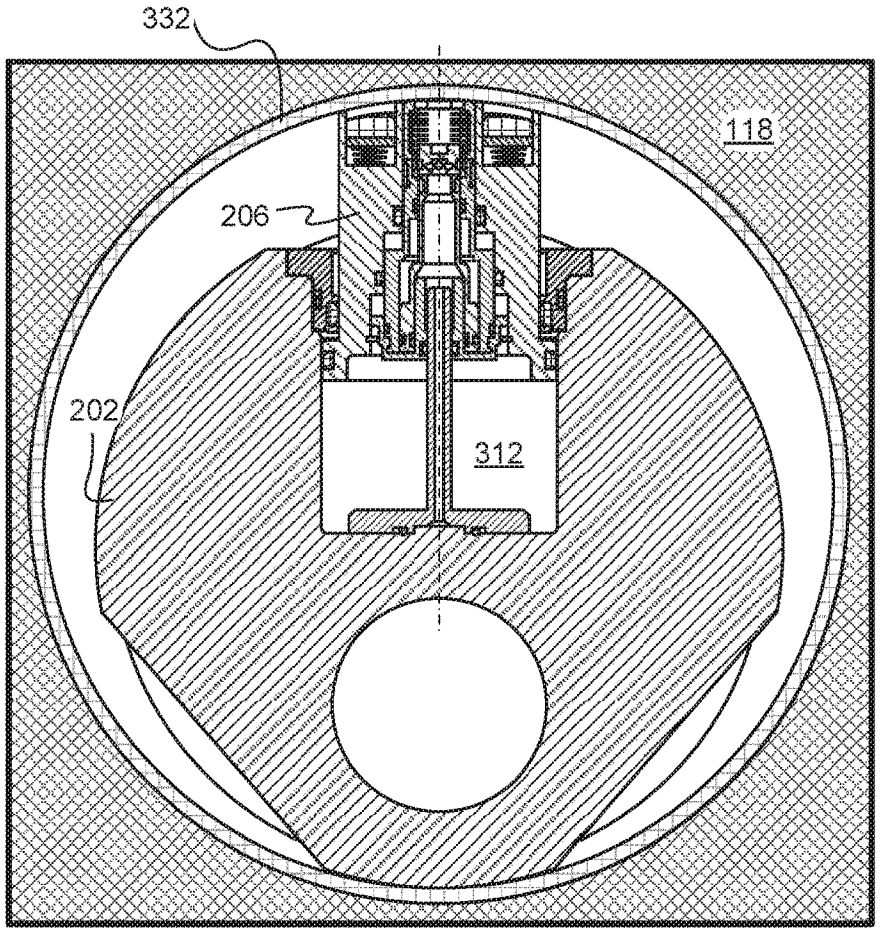
FIG. 7B depicts a schematic cross-section corresponding to that of FIG. 7A, a stabilizer provided by a probe piston of the tool being in a deployed condition in which hydraulically actuated radial expansion of the probe piston stabilizes the tool within the borehole.
Figure 7A:
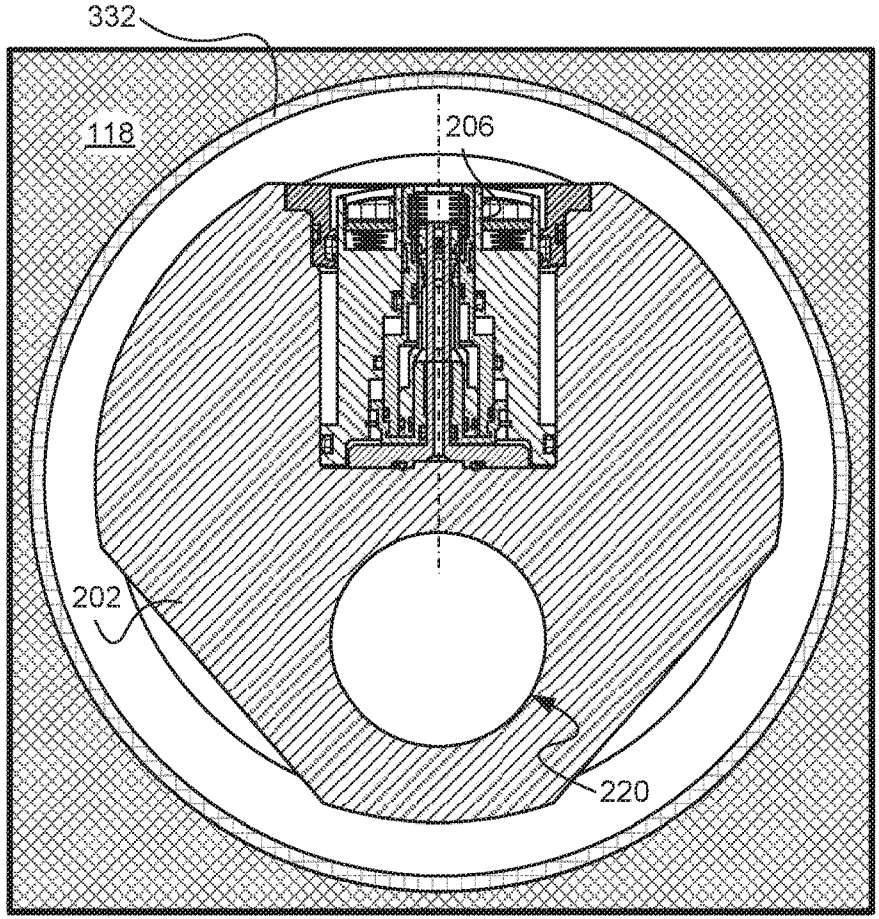
FIG. 7A depicts a schematic cross-section of a formation tester tool being located within a borehole in an inactive condition, according to an example embodiment

Such stabilization of the tool 130 by lateral/radial extension can best be seen with reference to FIG. 7. In FIG. 7A, the tool 130 is shown in its initial inactive mode, in which the outer periphery of the housing 202 is continuously spaced from the borehole wall 228. The tool housing 202 in this mode thus has at least some degree of movement relative to the borehole both radially towards the borehole wall 228, and axially along the borehole. When, however, the probe piston 206 is fully extended (FIG. 7B) the tool is forcefully pressed into contact with the borehole wall 228 at the contact surface of the probe piston 206 and at a diametrically opposite position on the radially outer periphery of the housing 202. The hydraulic actuating mechanism of the probe piston 206 continuously exerts an expansion force on the probe piston 206, thus securing or stabilizing the tool 130 in a specific position within the borehole 116. Both radial and axial movement of the tool housing 202 is in this stabilized position restricted by operation of the probe piston 206 and its actuating mechanism. Stabilization or lodging the tool 130 in the borehole 116 is necessary not only to lock the tool 130 in position for achieving a static interface between the snorkel 214 and the formation 118, but also to provide sufficient resistance to allow sufficiently forceful expansion of the snorkel 214 in order to penetrate the mudcake.

Note with reference to FIG. 7B that the stabilizing force exerted by the probe assembly 222 is transferred between the borehole wall 228 and the hydraulic actuation chamber 312 entirely by the rigid probe piston 206. The rigid metal contact formation provided by the contact surface 212 of the probe piston 206 (comprising the two concentric circular strips on either side of the seal pad 208 on the radially outer end face of the probe piston 206, as best seen in FIG. 2) is in direct forced contact engagement with the borehole wall 228. The probe piston 206 thus in this example embodiment provides a rigid stabilizer or stabilizing member forming part of a locking or stabilizing mechanism that includes the hydraulic actuating mechanism acting via the hydraulic actuation chamber. The stabilizer or probe piston 206 is described as being rigid, in that it is substantially incompressible at radial loads to which it is typically exposed for purposes of stabilizing the tester tool 130 in the borehole 116.

Note, in particular, that the seal pad 208, when it is in the disengaged position of FIG. 7B, is isolated from the stabilization load, which is borne substantially entirely by the probe piston 206 via its contact surface 212. Although the stabilizer of the tester tool 130 is in this example embodiment provided by a probe piston 206 that is of monolithic or one-piece construction, other embodiments may provide for an analogous stabilizer probe piston 206 that is a rigid composite structure.

Figure 8:
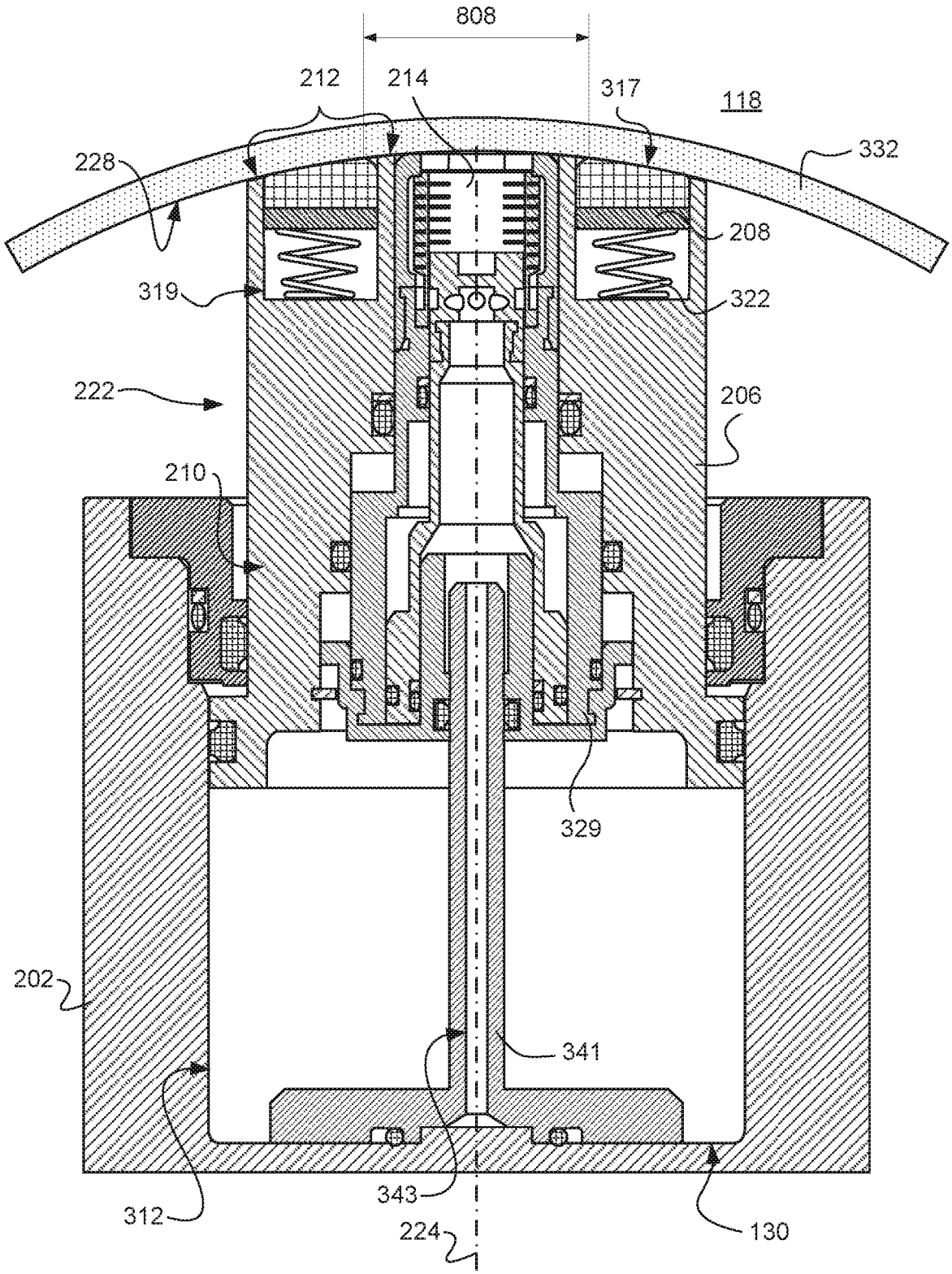
FIG. 8 depicts a schematic cross-section corresponding to that of FIG. 6, the seal pad mounted on the probe piston being in an engaged position in which it is in sealing contact with the borehole wall.
Figure 9:
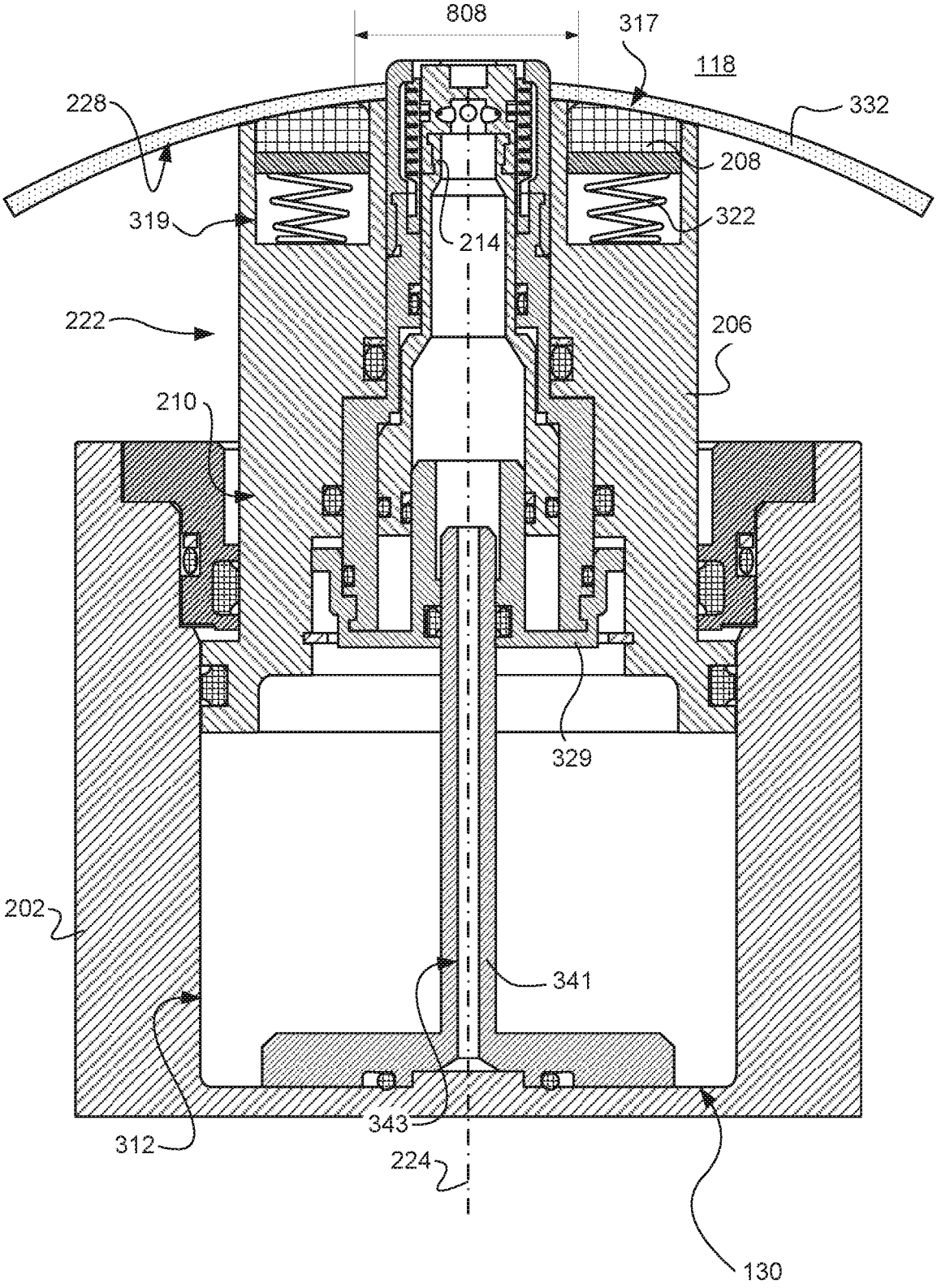
FIG. 9 depicts a schematic cross-section corresponding to that of FIG. 8, a snorkel forming part of the probe assembly being in an extended position in which it penetrates the formation through a mudcake layer at the borehole wall.

After stabilization of the tool 130 by the probe piston 206 (FIGS. 6 and 7B) a second stage of probe assembly deployment preparatory to formation testing is performed by causing sealing engagement of the seal pad 208 with the borehole wall 228, as shown in FIG. 8. This second stage deployment in the present example embodiment comprises automatic hydraulically actuated displacement of the seal pad 208 via the seal piston 316 radially outwards (i.e., away from the tool body in the direction of probe axis 224) into forced contact with the borehole wall 228. The outward displacement of the seal pad 208 into sealing contact with the borehole wall 228 is actuated hydraulically by pressurized expansion of the seal piston chamber 319, causing radially outward movement of the seal piston 316 against the retractive urging of the tension springs 322.

Thus, the radially outwardly directed sealing surface 317 of the seal pad 208 is brought into direct contact with the borehole wall 228 (here, bearing directly against mudcake 332). The "downforce" exerted hydraulically on the seal pad 208 (i.e., the force acting continuously on the seal pad radially outwardly, substantially normal to the borehole wall 228) is sufficiently large to create a substantially fluid-tight seal between the seal pad 208 and the borehole wall 228, causing compression of the seal pad 208. Note that the hydraulic arrangement of which the seal piston chamber 319 forms part provides not only a seal displacement mechanism for actuated displacement of the seal pad 208 from the disengaged position (FIG. 6) to the engaged position (FIG. 8), but also serves as an urging mechanism that continuously urges the seal pad radially against the borehole wall 228 to achieve continuous sealing engagement.

Because the sealing surface 317 extends circumferentially around the central passage of the probe piston 206 (relative to the probe axis 224), disposal of the seal pad 208 to the engaged position (FIG. 8) creates a substantially sealed isolation volume 808 that is bordered by the borehole wall 228 and the substantially circular sealing interface, the isolation volume 808 being isolated from fluid pressure in the borehole annulus and from fluid ingress past the seal pad 208. This allows exposure of the snorkel 214 to formation fluids and formation fluid pressure in isolation from drilling fluids and drilling fluid pressure in the borehole annulus.

Figure 7C:
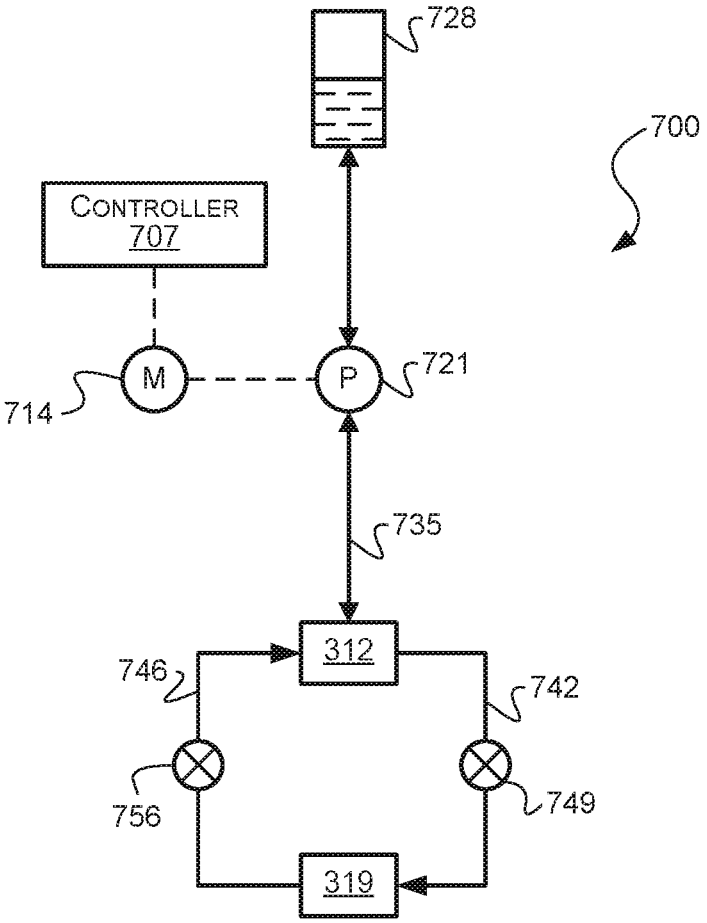
FIG. 7C depicts a simplified schematic representation of a hydraulic system forming part of a formation tester tool according to an example embodiment.

FIG. 7C shows a simplified schematic representation of one example embodiment of a hydraulic circuit 700 forming part of the tool 130 for hydraulically actuating two-stage movement of the probe piston 206 and the seal pad 208, as described. A microprocessor-based controller 707 is electrically coupled to all of the controlled elements of the hydraulic circuit 700. In this example embodiment, the controller 707 is housed in the controller module 132 (FIG. 1), but may in other embodiments be located within the housing 202 of the tool 130.

A motor 714 connected to the controller is coupled to a pump 721 that draws and returns hydraulic fluid (e.g., hydraulic oil) from and to a hydraulic reservoir 728 through a serviceable filter (not shown). The pump 721 is in fluid connection with the actuation chamber 312 of the tool 130 (FIG. 4) via a main fluid passage 735 defined by the housing 202.

Fluid connections are further provided between the actuation chamber 312 and the seal piston chamber 319 (FIG. 4) via a terminal fluid passage 742 and a return fluid passage 746, both of which extend through the probe piston 206 (FIG. 4). A graded check valve 749 is located in the terminal fluid passage 742 to permit one way flow through the terminal fluid passage 742 from the actuation chamber 312 to the seal piston chamber 19 only if a pressure differential between the chambers are greater than a predefined threshold pressure. It will be appreciated that this pressure differential corresponds to the previously described threshold pressure at which hydraulic actuation of the seal piston 316 into the engaged position is automatically triggered. A one-way return valve 756 is likewise located in the return fluid passage 746 to permit flow of the hydraulic fluid from the seal piston chamber 319 to the actuation chamber 312 when the pressure differential is oppositely oriented.

In operation, deployment of the probe piston 206 and the seal piston 316 comprises pumping of hydraulic fluid from the reservoir 728 into the actuation chamber 312 via the main fluid passage 735. While the hydraulic pressure is below the threshold selected by grading of the check valve 749, the seal piston chamber 319 is isolated from the actuation chamber 312, and the seal piston 316 remains retracted in the probe piston 206. When, however, the hydraulic pressure exceeds the threshold, the check valve 749 automatically opens, allowing hydraulic fluid to flow into the seal piston chamber 319, actuating movement of the seal pad 208 into the engaged position.

To retract the probe assembly 222, the pump 721 returns hydraulic fluid to the reservoir 728, causing hydraulic fluid to flow from the seal piston chamber 319 to the actuation chamber 312 via the return fluid passage 746, thus retracting the seal piston 316. Likewise, withdrawal of hydraulic fluid from the actuation chamber 312 causes hydraulic retraction of the probe piston 206.

One benefit of the described techniques is that even in the engaged, sealing condition of FIG. 8, the seal pad 208 is exposed only to a radial load downforce selected to be sufficient to create the sealing engagement, and that the seal pad 208 continues to be isolated from exposure to the radial stabilization load by the probe piston 206. This is in contrast to the operation of many existing probe assemblies, in which contact engagement with the borehole wall 228 (before snorkel deployment) is substantially exclusively via a seal pad. In such cases, the stabilization load is transferred between the tool body and the borehole wall 228 by the seal pad. In contrast, the seal pad 208 of the example tester tool 130 is exposed only to the sealing load.

Such isolation of the seal piston 316 from the stabilization load is achieved in this example embodiment by providing for contact engagement between with the borehole wall 228 at different respective contact areas for, on the one hand, probe piston 206, and for, on the other hand, the seal piston 316. As can most readily be understood by considering the view of FIG. 8 in combination with that of FIG. 2, it will be seen that the contact area between the seal piston 316 and the borehole wall 228 is provided by the sealing surface 317 defined by the annular radially outer end face of the seal piston 316. The contact area between the probe piston 206 and the borehole wall, on the other hand, is provided by the contact surface 212 of the probe piston 206 defined by the pair of annular end face portions defining between them the annular cavity 303.

Because the stabilization load is typically larger than the downforce or sealing load necessary to create a sealing interface, the seal pad 208 of the tool 130 consistent with this disclosure is thus subjected to lesser compressive loads during each deployment cycle. As a result, it is a benefit of the described embodiment that it provides for reduced seal fatigue, improving seal life expectancy and thereby reducing operating costs.

Note also that the seal pad 208 is, in the engaged position (FIG. 8), laterally restrained (relative to the probe axis 224) by the rigid probe piston 206. In particular, the inner diameter and the outer diameter of the seal pad 208 (relative to the probe axis 224) are in sliding contact or closely spaced from respective corresponding portions of the cavity wall of the annular recess 210 in the probe piston 206. During compression of the seal pad 208, lateral expansion of the seal pad 208 is prevented or restricted by the probe piston 206. This provides for increased effective stiffness of the seal pad 208, which results in a smaller compressive load being required to create a sealing interface than would otherwise be the case.

Yet a further benefit of the sealing mechanism of the example tool 130 is that hydraulic actuation of the seal pad 208 via an annular actuation chamber (in this case the seal piston chamber 319) is that it achieves substantially constant distribution of radial downforce on the seal pad 208. This is because irregularities in resistive forces experienced by the seal pad 208 is counteracted by substantially instantaneous pressure equalization throughout the seal piston chamber 319. The seal pad 208 and seal piston 316 can thus be described as "floating" on a bed of pressurized hydraulic liquid. As a result, slight misalignment of the probe piston 206 against the borehole wall 228, or irregularities on the borehole wall 228 is automatically accommodated by pressure equalization in the seal piston chamber 319, promoting substantially even distribution of the sealing load on the seal pad 208.

After full deployment of an stabilization by the probe piston 206, and after engagement of the seal piston 316 to seal against the borehole wall 228, the snorkel 214 may be hydraulically actuated to penetrate the mudcake and expose the measurement passageway 343 to formation fluid via a composite flow passage defined by the collective hollow interiors of the snorkel 214 and a portion of the carrier piston 329. Instrumentation measurement incorporated in the tool housing 202 and in fluid flow communication with the passageway 343 is thus enabled to measure formation fluid properties (e.g., formation fluid pressure) and/or to collect a formation fluid sample.

Thereafter, the probe assembly is retracted and collapsed in a sequence of operations opposite to that described with reference to FIGS. 3-9. Thus, the snorkel 214 is retracted, followed by radially inward displacement of the seal piston 316 under operation of the tension springs 322 to its disengaged position in which it is spaced from the borehole wall 228, whereafter the probe piston 206 is fully retracted within the housing 202, thus returning the tool 130 to the inactive mode of FIG. 3.

As mentioned previously, the described example embodiments display a number of benefits over prior formation testers. In particular, seal pad life cycle and reliability is increased by reduced exposure to radial compressive forces owing to contact engagement of the borehole wall with the stabilizer (e.g. probe piston 206). The seal pad is thus shielded from at least some of the radial load. Reliability and quality of seal formation is also promoted by hydraulic mounting of the seal piston 316, to allow at least some play between it and the probe piston 206 and to provide for even distribution of radial force on the seal piston 316.

Some aspects of the described example embodiment may be changed in other embodiments. For example, the seal pad may be mounted on the piston such that it is not hydraulically actuated. In one embodiment, for example the seal pad may be mounted on resiliently compressible urging mechanism, such as compression springs. In such case, the seal may stand proud of the outer end face of the probe piston when in the active mode, being pushed inwards into its mounting recess until the outer end face of the probe piston contacts the borehole wall. The properties of such compression springs and a radial spacing of the seal pad outer surface in the unstressed condition may be selected such that, when the seal pad is pushed radially inwards to its full extent, the radially outward force exerted by the compression springs is sufficient to cause sealing engagement with the borehole wall.

The following numbered examples are illustrative embodiments in accordance with various aspects of the present disclosure, at least some of which are exemplified by the foregoing description of a detailed example embodiment.

1. A tool assembly may comprise:
   - a tool body defining a tool axis, the tool body configured to be receivable in a borehole defined by a borehole wall;
   - a stabilizer mounted on the tool body, the stabilizer displaceable in a direction transverse to the tool axis;
   - an actuating mechanism coupled to the stabilizer and configured to move the stabilizer between:
   - a retracted position in which the stabilizer is spaced from the borehole wall, and a deployed position in which a contact surface of the stabilizer engages the borehole wall at a first location;
   - a seal mounted on the stabilizer and configured to sealingly engage the borehole wall at a second location when the stabilizer is in the deployed position to define a sealed isolation zone isolated from borehole fluids; wherein the second location is spaced from the first location; and
   - a testing mechanism within the tool body and configured for testing one or more formation properties in the isolation zone.

2. The tool assembly of example 1, further comprising a bias mechanism configured to press the seal radially against the borehole wall when the stabilizer is in the deployed position, the bias mechanism acting between the stabilizer and the seal. The bias mechanism may in some example embodiments be provided by a hydraulic urging mechanism as described with reference to FIGS. 3-9.

3. The tool assembly of example 1 or example 2 wherein:
   - the stabilizer comprises a probe piston that is reciprocally moveable in a generally radial direction relative to the tool body, the probe piston having a hollow interior providing fluid communication between the formation and the measurement instrumentation when the probe piston is in the deployed position; and
   - wherein the actuating mechanism includes a hydraulic system to move the probe piston into the deployed position.

4. The tool assembly of any of the preceding examples, wherein the seal is movable on the stabilizer in the deployed position, between:
   - a disengaged position; and
   - an engaged position in which the seal sealingly engages the borehole wall.

5. The tool assembly of example 4, wherein an end face of the stabilizer defines the contact surface of the stabilizer.

6. The tool assembly of example 5, wherein the contact surface of the stabilizer has an arcuate form oriented to generally correspond to the borehole wall.

7. The tool assembly of example 6, wherein the seal is substantially annular and in the disengaged position defines a radial sealing surface having an arcuate form oriented to generally correspond to curvature of the borehole wall.

8. The tool assembly of any one of examples 4 to 7, further comprising a seal actuating mechanism to move the seal relative to the stabilizer from the disengaged position to the engaged position, and to bias the seal against the borehole wall while the seal is in the engaged position. In some example embodiments, the seal actuating mechanism may be provided by a seal displacement mechanism as described with reference to FIGS. 3-9.

9. The tool assembly of example 8, wherein the seal is carried by a seal piston movably mounted on the stabilizer, and wherein the seal actuating mechanism includes a hydraulic system to move the seal piston relative to the stabilizer towards the borehole wall.

10. The tool assembly of example 9, wherein the seal piston is annular and is received in a complementary annular piston chamber in the radial end face of the stabilizer.

11. The tool assembly of example 10, wherein the piston chamber contains hydraulic fluid.

12. The tool assembly of example 10 or example 11, wherein the contact surface of the stabilizer is defined by a pair of annular surfaces forming part of the radial end face of the stabilizer and flanking the piston chamber.

13. The tool assembly of any one of examples 9-12, wherein the seal actuating mechanism includes a return mechanism to retract the seal piston from the engaged position responsive to a hydraulic actuating pressure of the seal displacement mechanism falling below a threshold.

14. The tool assembly of any one of examples 9-14, wherein the seal in the disengaged position is wholly retracted within the stabilizer, so that the contact surface of the stabilizer is located radially beyond the seal.

15. A method comprising:

locating a formation tester tool having tool body in a borehole defined by a borehole wall;

moving a stabilizer mounted on the tool body for transverse movement between a retracted position and a deployed position in which a contact surface of the stabilizer forcibly engages the borehole wall, to stabilize the tool body within the borehole;

while the stabilizer is in the deployed condition, causing an active seal carried by the stabilizer to sealingly engage the borehole wall at a sealing surface spaced from the contact surface of the stabilizer, thereby to define a sealed isolation zone isolated from borehole fluids; and testing one or more formation properties by exposing a testing mechanism forming part of the tool to the isolation zone.

16. The method of example 15, wherein the contact surface of the stabilizer has an arcuate form to generally correspond to the borehole wall, such that engagement of the stabilizer with the borehole wall in the deployed position results in substantially all of the contact surface contacting the borehole wall.

17. The method of example 15 or example 16, wherein causing the active seal to engage the borehole wall comprises moving the active seal radially from a disengaged position in which the active seal is clear of the borehole wall into sealing engagement with the borehole wall.

18. The method of example 16, wherein the active seal is generally annular, and wherein the causing the active seal to sealingly engage the borehole wall comprises hydraulically actuating movement of the active seal via a generally annular piston chamber defined by the stabilizer and in which the active seal is movably located.

In other embodiments, the method of example 15 may have the respective features of any one of examples 1-14.

19. A system comprising:

a well tool assembly receivable within a borehole defined by a borehole wall; and a formation tester tool incorporated in the well tool assembly, the formation tester tool comprising:

a tool body defining a tool axis;

a stabilizer mounted on the tool body, the stabilizer displaceable transversely to the tool axis;

an actuating mechanism coupled to the stabilizer and configured to move the stabilizer between a retracted position in which the stabilizer is spaced from the borehole wall, and a deployed position in which the stabilizer engages the borehole wall at a first location;

a seal mounted on the stabilizer and configured to sealingly engage the borehole wall at a second location when the stabilizer is in the deployed position, to define a sealed isolation zone isolated from borehole fluids, wherein the second location is spaced from the first location; and a testing mechanism configured for testing one or more formation properties in the isolation zone.

20. The system of example 19, wherein the well tool assembly is coupled in a drill string.

In other embodiments, the system of claim 19 may have the respective features of any one of examples 1-14.

21. A tool assembly comprising:

a tool body configured to be receivable in a borehole extending through a subterranean formation such that a tool axis defined by the tool body is disposed substantially axially relative to a generally cylindrical borehole wall;

a rigid stabilizer mounted on the tool body to be displaceable in a direction transverse to the tool axis;

an actuating mechanism configured for causing actuated disposal of the stabilizer between:

a retracted condition in which the stabilizer is spaced from the borehole wall, permitting movement of the tool body relative to the borehole wall, and a deployed condition in which the stabilizer is in contact engagement with the borehole wall and is urged against the borehole wall to stabilize the tool body within the borehole;

a seal member that is mounted on the stabilizer and that is configured to be sealingly engageable, when the stabilizer is in the deployed condition, with the borehole wall so as to define a sealed isolation zone that is in fluid isolation from borehole fluids and that is bordered by the borehole wall, the seal member and the stabilizer being configured for contacting the borehole wall at different respective contact areas; and a testing mechanism configured for testing one or more formation properties in the isolation zone.

22. The tool assembly of example 1, further comprising an urging mechanism configured to urge the seal member radially against the borehole wall when the seal member is in the deployed condition, the urging mechanism acting between the stabilizer and the seal member.

23. The tool assembly of example 1 or example 2, wherein:

the stabilizer comprises a probe piston that is reciprocally slidable relative to the tool body in a radial direction relative to the tool axis, the probe piston having a hollow interior configured to permit establishment, when the probe piston is in the deployed condition, of a fluid connection between the formation in the isolation zone and measurement instrumentation housed by the tool body; and wherein the actuating mechanism is configured for effecting hydraulic actuation of the probe piston into the deployed condition.

24. The tool assembly of any one of examples 21-23, wherein the seal member is mounted on the stabilizer to be displaceable, while the stabilizer is in the deployed condition, between:

a disengaged position; and an engaged position in which the seal member s in sealing engagement with the borehole wall.

25. The tool assembly of example 24, wherein a radially outer end face of the stabilizer, relative to the tool axis, is configured to provide a contact surface for bearing against the borehole wall in the deployed condition.

26. The tool assembly of example 25, wherein the contact surface of the stabilizer has a part-cylindrical curvature corresponding to a cylindrical curvature of the borehole wall, thereby to allow substantially continuous flush contact between the borehole wall and substantially the entirety of the contact surface.

27. The tool assembly of any one of examples 24-26, wherein the seal member has a substantially annular sealing surface that is directed radially outwardly relative to the tool axis and that has a part-cylindrical curvature conforming substantially to the cylindrical curvature of the borehole wall.

28. The tool assembly of any one of examples 25-27, further comprising a seal displacement mechanism that is configured for causing actuated displacement of the seal member relative to the stabilizer between the disengaged position and the engaged position, the seal displacement mechanism further being configured to continuously urge the seal member radially against the borehole wall when the stabilizer is in the deployed condition and the seal member is in the engaged position.

29. The tool assembly of example 28, wherein the seal displacement mechanism comprises a seal piston on which the seal member is mounted, the seal piston being mounted on the stabilizer for hydraulically actuated movement relative to the stabilizer in a direction substantially radial relative to the tool axis.

30. The tool assembly of example 29, wherein the seal piston is substantially annular in shape and is received in a complementary substantially annular recess in the radially outer end face of the stabilizer.

31. The tool assembly of example 30, wherein the seal displacement mechanism of the seal member further includes a substantially annular hydraulic chamber defined between the seal piston and interior walls of the annular recess.

32. The tool assembly of any one of examples 30-31, wherein the contact surface of the stabilizer is defined by a pair of exposed surfaces forming part of the radially outer end face of the stabilizer and respective extending circumferentially about an inner diameter periphery and an outer diameter periphery of the annular recess.

33. The tool assembly of any one of claims 29-32, wherein the seal displacement mechanism includes a return mechanism configured to cause automatic radially inward retraction of the seal piston from the engaged position to the disengaged position responsive to hydraulic actuating pressure of the seal displacement mechanism falling below a predefined threshold.

34. The tool assembly of any one of examples 29-33, wherein the seal member is mounted on the stabilizer such that, when the seal member is in the disengaged position, the seal member is wholly retracted within the stabilizer, so that no part of the seal pad projects radially beyond the contact surface of the stabilizer, relative to the tool axis.

35. A method comprising:

locating a tool body configured for reception in a borehole extending through a subterranean formation and having a borehole wall that extends circumferentially about a borehole axis;

displacing a rigid stabilizer mounted on the tool body in a direction transverse to the borehole axis between a retracted condition in which the stabilizer is clear of the borehole wall, and a deployed condition in which the stabilizer is in contact engagement with the borehole wall and stabilizes the tool body within the borehole by acting radially against the borehole wall;

causing sealing engagement of the borehole wall, while the stabilizer is in the deployed condition, by a seal member mounted on the stabilizer, thereby to define a sealed isolation zone that is in fluid isolation from borehole fluids and that is bordered by the borehole wall, the seal member and the stabilizer contacting the borehole wall at different respective contact areas; and testing one or more formation properties by exposure to the formation in the isolation zone.

36. The method of example 35, wherein a radially outer end face of the stabilizer, relative to the borehole tool axis provides a part-cylindrical contact surface having a cylindrical curvature similar to that of the borehole wall, the contact engagement between the stabilizer and the borehole wall comprising substantially continuous flush contact of the contact surface against the borehole wall.

37. The method of example 35 or 36, wherein the causing of the sealing engagement of the seal member with the borehole wall comprises, while the stabilizer is in the deployed condition, displacing the seal member radially relative to the borehole axis from a disengaged position, in which the seal member is clear of the borehole wall, into an engaged position in which the seal member bears radially against the borehole wall. In other embodiments, the seal member may provide a passive seal, in which the seal member contacts the borehole wall before the stabilizer, being urged into the stabilizer with continued extension of the stabilizer toward the borehole wall. The seal member may in such case be mounted on the stabilizer such that the displacement of the seal member into the stabilizer is limited (e.g., by contact engagement of the stabilizer against the borehole wall) to an extent corresponding to a predetermined compressive force experienced by the seal member. Displacement of the seal member may in such case be against a bias or urging mechanism (e.g., a hydraulic resistance such as a resilient diaphragm, and/or a resilient mechanical resistance such as one or more compression springs) that urges the seal member radially outwards. In this manner, exposure of the seal member to the stabilizing load is limited by limitation of linear displacement of the seal member on the stabilizer, with a sealing force that creates the sealing engagement being provided by the bias or urging mechanism of the seal member.

38. The method of any one of examples 35-37, wherein the displacing of the stabilizer into the deployed condition and the displacing of the of the seal member into the engaged position comprises hydraulic actuation of the stabilizer and the seal member that is staggered in time, providing for a two-stage deployment operation for provision of the isolation zone.

39. A system comprising:

a well tool assembly received within a borehole that extends through a subterranean formation and that has a borehole wall extending circumferentially about a lengthwise borehole axis; and a formation tester tool incorporated in the well tool assembly, the formation tester tool comprising:

a tool body;

a rigid stabilizer mounted on the tool body to be displaceable in a direction transverse to the borehole axis;

an actuating mechanism configured for causing actuated disposal of the stabilizer between a retracted condition in which the stabilizer is spaced from the borehole wall, and a deployed condition in which the stabilizer is in contact engagement with the borehole wall and is urged against the borehole wall to stabilize the tool body within the borehole;

a seal member that is mounted on the stabilizer and that is configured to be sealingly engageable, when the stabilizer is in the deployed condition, with the borehole wall so as to define a sealed isolation zone that is in fluid isolation from borehole fluids and that is bordered by the borehole wall, the seal member and the stabilizer being configured for contacting the borehole wall at different respective contact areas; and a testing mechanism configured for testing one or more formation properties in the isolation zone.

40. The system of example 39, wherein the well tool assembly is a drill string.

In the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. A tool assembly comprising:

a tool body defining a tool axis, the tool body configured to be receivable in a borehole defined by a borehole wall;

a stabilizer mounted on the tool body, the stabilizer displaceable in a direction transverse to the tool axis;

an actuating mechanism coupled to the stabilizer and configured to move the stabilizer between: a retracted position in which the stabilizer is spaced from the borehole wall, and a deployed position in which a contact surface of the stabilizer engages the borehole wall at a first location;

a seal mounted on the stabilizer and configured to sealingly engage the borehole wall at a second location in response to the stabilizer engaging the borehole wall, to define a sealed isolation zone isolated from borehole fluids; wherein the second location is spaced from the first location; and a testing mechanism within the tool body and configured for testing one or more formation properties in the isolation zone.

2. The tool assembly of claim 1, further comprising a seal actuating mechanism configured to press the seal radially against the borehole wall when the stabilizer is in the deployed position, the seal actuating mechanism acting between the stabilizer and the seal.

3. The tool assembly of claim 1, wherein:

the stabilizer comprises a probe piston that is reciprocally moveable in a generally radial direction relative to the tool body, the probe piston having a hollow interior providing fluid communication between the formation and measurement instrumentation when the probe piston is in the deployed position; and wherein the actuating mechanism includes a hydraulic system to move the probe piston into the deployed position.

4. The tool assembly of claim 1, wherein the seal is movable on the stabilizer in the deployed position, between:

a disengaged position; and an engaged position in which the seal sealingly engages the borehole wall.

5. The tool assembly of claim 4, wherein an end face of the stabilizer defines the contact surface.

6. The tool assembly of claim 5, wherein the contact surface of the stabilizer has an arcuate form oriented to generally correspond to the borehole wall.

7. The tool assembly of claim 6, wherein the seal is substantially annular and in the disengaged position defines a radial sealing surface having an arcuate form oriented to generally correspond to curvature of the borehole wall.

8. The tool assembly of claim 4, further comprising a seal actuating mechanism to move the seal relative to the stabilizer from the disengaged position to the engaged position, and to bias the seal against the borehole wall while the seal is in the engaged position.

9. The tool assembly of claim 8, wherein the seal is carried by a seal piston movably mounted on the stabilizer, and wherein the seal actuating mechanism includes a hydraulic system to move the seal piston relative to the stabilizer towards the borehole wall.

10. The tool assembly of claim 9, wherein the seal piston is annular and is received in a complementary annular piston chamber in a radial end face of the stabilizer.

11. The tool assembly of claim 10, wherein the piston chamber contains hydraulic fluid.

12. The tool assembly of claim 10, wherein the contact surface of the stabilizer is defined by a pair of annular surfaces forming part of the radial end face of the stabilizer and flanking the piston chamber.

13. The tool assembly of claim 9, wherein the seal actuating mechanism includes a return mechanism to retract the seal piston from the engaged position responsive to a hydraulic actuating pressure of the seal displacement mechanism falling below a threshold.

14. The tool assembly of claim 9, wherein the seal in the disengaged position is wholly retracted within the stabilizer, so that the contact surface of the stabilizer is located radially beyond the seal.

15. The tool assembly of claim 1, further comprising a seal actuating mechanism to move the seal relative to the stabilizer from a disengaged position to an engaged position in which the seal sealingly engages the borehole wall.

16. A method comprising:

locating a formation tester tool having tool body in a borehole defined by a borehole wall;

moving a stabilizer mounted on the tool body for transverse movement between a retracted position and a deployed position in which a contact surface of the stabilizer forcibly engages the borehole wall, to stabilize the tool body within the borehole;

in response to a contact surface of the stabilizer forcibly engaging the borehole wall, causing an active seal carried by the stabilizer to sealingly engage the borehole wall at a sealing surface spaced from the contact surface of the stabilizer, thereby to define a sealed isolation zone isolated from borehole fluids; and testing one or more formation properties by exposing a testing mechanism forming part of the tool to the isolation zone.

17. The method of claim 16, wherein the contact surface of the stabilizer has an arcuate form to generally correspond to the borehole wall, such that engagement of the stabilizer with the borehole wall in the deployed position results in substantially all of the contact surface contacting the borehole wall.

18. The method of claim 17, wherein the active seal is generally annular, and wherein the causing the active seal to sealingly engage the borehole wall comprises hydraulically actuating movement of the active seal via a generally annular piston chamber defined by the stabilizer and in which the active seal is movably located.

19. The method of claim 16, wherein causing the active seal to engage the borehole wall comprises moving the active seal radially from a disengaged position in which the active seal is clear of the borehole wall into sealing engagement with the borehole wall.

20. The method of claim 16, further comprising moving, by a seal actuating mechanism, the active seal relative to the stabilizer between a disengaged position and an engaged position in which the active seal sealingly engages the borehole wall.

21. A system comprising:

a well tool assembly receivable within a borehole defined by a borehole wall; and a formation tester tool incorporated in the well tool assembly, the formation tester tool comprising:

a tool body defining a tool axis;

a stabilizer mounted on the tool body, the stabilizer displaceable transversely to the tool axis;

an actuating mechanism coupled to the stabilizer and configured to move the stabilizer between a retracted position in which the stabilizer is spaced from the borehole wall, and a deployed position in which the stabilizer engages the borehole wall at a first location;

a seal mounted on the stabilizer and configured to sealingly engage the borehole wall at a second location in response to the stabilizer engaging the borehole wall at the first location, to define a sealed isolation zone isolated from borehole fluids, wherein the second location is spaced from the first location; and a testing mechanism configured for testing one or more formation properties in the isolation zone.

22. The system of claim 21, wherein the well tool assembly is coupled in a drill string.

23. The system of claim 21, further comprising a seal actuating mechanism to move the seal relative to the stabilizer from a disengaged position to an engaged position in which the seal sealingly engages the borehole wall.

* * * * *